United States Patent [19]

Harris

[11] 4,176,355

[45] Nov. 27, 1979

[54] RADIATION REFLECTING TARGET SURFACE

[76] Inventor: Stanley R. Harris, 710 Washington St., Venice, Calif. 90291

[21] Appl. No.: 868,893

[22] Filed: Jan. 12, 1978

[51] Int. Cl.[2] ..... H01Q 15/18

[52] U.S. Cl. ..... 343/18 C

[58] Field of Search ..... 343/18 C

[56] References Cited

U.S. PATENT DOCUMENTS

| | | | |
|---|---|---|---|
| 2,310,790 | 2/1943 | Jungersen | 343/18 C X |
| 3,153,235 | 10/1964 | Chatelain | 343/18 C |
| 3,200,400 | 8/1965 | Gill, Jr. | 343/18 C |
| 4,096,479 | 6/1978 | Van Buskirk | 343/18 C |

FOREIGN PATENT DOCUMENTS

| | | | |
|---|---|---|---|
| 830654 | 3/1960 | United Kingdom | 343/18 C |

*Primary Examiner*—T. H. Tubbesing

*Attorney, Agent, or Firm*—Marvin H. Kleinberg; Seymour A. Scholnick; Thomas A. Turner, Jr.

[57] ABSTRACT

A radiation reflective surface for use with non-reflective type marine vessels has dimple-type retroflective surfaces having right angle corners. The reflecting surface of the target comprises a generally smooth, substantially spherical structure having no sharp cutting edges, while providing retro-reflecting surfaces to impinging radiation at the frequencies expected in the "radar" range.

20 Claims, 12 Drawing Figures

RADIATION REFLECTING TARGET SURFACE

BACKGROUND OF THE INVENTION

1. Field of the Invention

The present invention relates to radiation reflecting target surfaces, and more particularly to radar reflecting targets for returning impinging radar radiation in a path substantially parallel to the impinging beam.

2. Description of the Prior Art

More and more marine vessels are being launched and used in waters near or adjacent population dense areas. Frequently, in dense fogs, during exceptionally dark nights or in the turbulence of storms, even the best running lights appear terribly small and ineffective in a big ocean. Many if not most marine vessels are equipped with radar equipment adapted to inform the operator of nearby ships and structures in such circumstances.

Small and medium size sailboats and powerboats frequently are constructed of materials having almost no substantial surface area of radar reflecting characteristics. The hulls, decks and masts are frequently made of wood, fiberglass, or other plastic materials. Such small vessels can be absolutely invisible to radar detection.

In inclement weather or fog, most prudent sailors in crowded harbors and bays presently equip their vessel or boat with small, manually operated fog horns. Such horns have their usefulness, but reasonably cannot be expected to provide notice to large, ocean going vessels such as tankers, or to smaller vessels traveling at relatively high rates of speed and having substantial engine noise. To be "seen" by such vessels having radar equipment, it is highly desirable to have a radar reflecting target capable of being elevated and supported on a mast or perhaps secured over a rail. The height of the antenna above the water line determines the effective range of the radar which range is also affected by the height of the target vessel.

Several such radar targets or reflectors are currently available. The most effective of such targets attempts to utilize the well known corner or dihedral angle reflecting surface technique. For example, three mutually orthogonal planes, reflective on both sides and intersecting in a common point or vertex, frequently form the construction for such a reflector.

Such constructions, however, have been known to provide dangerously rough edges. In the past, such reflector targets have been known to damage masts and boat hulls. A substantially cylindrical reflector commercially available appears to claim a maze of prisms that would return signals at heeling angles of up to 35 degrees. Surprisingly, such arrangements apparently are ineffective.

It continues to be desired, therefore, to obtain a relatively small, yet highly reflective surface that will return radar radiation in paths substantially parallel to an impinging path. Moreover, it is extremely desirable to provide such a radiation reflector or target that can be attached easily to marine vessels without scarring or damaging the vessel or the operator.

SUMMARY

In accordance with one aspect of the present invention, a spherical radiation reflective surface has dimples formed from the surface into the sphere's interior. The dimples have right angle corners or vertices and present radiation frequency windows at approximately the surface of the sphere. The sphere is formed with as many of the dimples as is possible, leaving very little reflective area on the sphere surface itself.

The entire structure is coated or otherwise provided with a material that is highly reflective to illuminating radiation in the radar frequencies, such as aluminum. The individual apertures or openings of the dimples, in one embodiment, have diameters or cross-dimensions that are only a fraction of the wavelength of the expected radar radiation to be reflected.

In alternative embodiments, a sphere is provided with intrusions on the inner surface of a hollow sphere which, when coated with a reflective material such as aluminum or copper, provides a suitable reflecting body, with a substantially smooth, weather impervious outer surface.

The entire reflective target is optimally constructed having no sharp edges. The substantially spherical structure is diametrically mounted on a cable. The cable preferably has means outside the sphere for attachment to halyards, ropes or other devices common to a marine vessel.

In the preferred embodiment, the essentially spherical structure is rotatable around the cable. Particular mounting arrangements are shown providing for the free, diametrical rotation characteristic.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is expressly to be understood, however, that the drawings are for the purpose of illustration and description only and are not intended as a difinition of the limits of the invention.

DESCRIPTION OF THE PREFERRED EMBODIMENT

Figure 1:
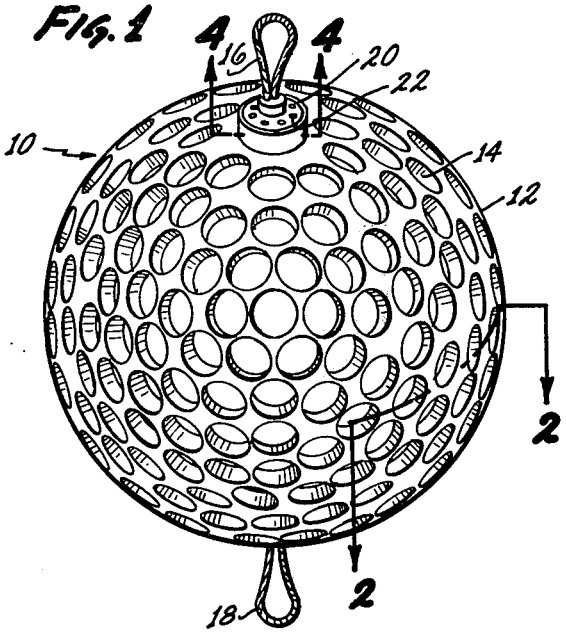
FIG. 1 is a perspective view of a preferred embodiment of a reflector target according to the present invention.

In FIG. 1, a radar reflecting target 10 is shown in perspective. The target 10 comprises a generally spherical structure having dimples or indentations 14 recessed from the partially spherical surface 12. The surface 12 would be substantially spherical but for the apertures defining exterior openings from the dimples 14.

A cable 16 is threaded diametrically through the target 10 to have loops 18 at diametrically opposite positions outside the partially spherical surface 12. The cable 16 is protected by cylindrical necks 20 having drain holes 22, which will be explained in greater detail below.

Figure 3:
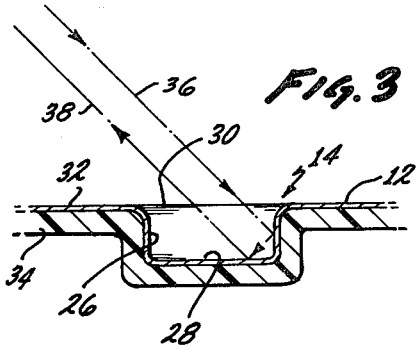
FIG. 3 is a detailed cross-section view of a portion of FIG. 2, as seen along line 3—3 in the direction of the arrows.
Figure 2:
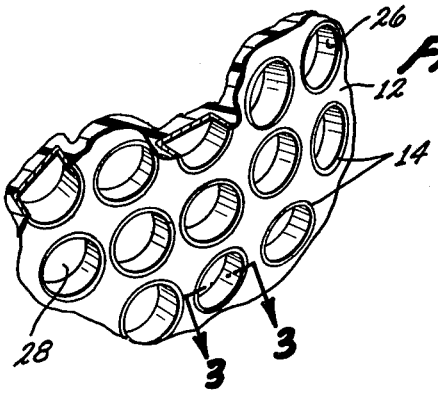
FIG. 2 is a partial, cut away of the reflector target of FIG. 1 as seen along line 2—2 in the direction of the arrows.

In FIGS. 2 and 3, enlarged detail of the dimples 14 can be seen in a partial cutaway view. FIG. 3 is a cross-sectional detail of a representative dimple 14 of FIG. 2.

The dimples 14 have a cylindrical shape formed by a cylindrical sidewall 26 and a generally flat cylinder end 28. The cylinder end 28 is normal to an axis of the sidewall 26.

The cylindrically shaped dimples 14 have the capability of reflecting impinging radiation in accordance with the well known corner reflecting principle. Except for purposes of generally explaining the structure of the present invention, the corner reflecting principle will not be explained in physical detail. The reader is referred to elementary physics texts for detailed explanation. A representative example of such a text would be Halliday and Resnick, "*Physics for Students of Science and Engineering*", 2d ed. (1962).

Each dimple 14 has an opening 30 exposing the recess of the dimple to the exterior. The surface of the target 10, of the cylindrical wall 26 and of end 28 is plated or coated with a thin radiation reflective surface material 32, such as aluminum. The aluminum may be deposited, such as by electrode deposition, or otherwise formed on a substrate 34. The substrate 34 may be preformed of resin or a plastic material, and should be sufficiently thick to withstand re-shaping by wind and normal manual use. The dimples having the radiation reflecting surface can be formed in other structures and with other methods which will be described in greater detail below as alternative embodiments.

Radiation, such as from a radar system will impinge on the target 10, the radiation having axes of travel which can be considered to be generally parallel to each other. At least one of these axes will more likely impinge one of the dimples 14 along its axis. For all of the other dimples, the axes of the impinging radiation will form an angle with the axis of the dimple impinged. Thus, if an axis 36 of an impinging radiation enters through opening 30 of one of the dimples 14, the radiation will impinge on the cylindrical sidewall 26, initially as indicated in FIG. 3. The radiation will then be reflected by the cylindrical sidewall 26 so that it impinges and reflects similarly off of the end surface 28. The reflected radiation will have an axis 38 which is substantially parallel to the axis 36 of the impinging radiation.

The depth of the dimple 14 will be relatively shallow as compared to the diameter, so that for a greater number of dimples 14 receiving the substantially parallel incident radiation, there will be only two reflections of the incident radiation. Only one of these reflections would be off of the cylindrical sidewall 26, as illustrated in FIG. 3. Thus, it can be seen that not only a dimple having an axis relatively coincidental with an impinging radiation, but also a large number of adjacent dimples whose axes are not coincidental with the impinging radiation, will receive the impinging radiation and reflect it in substantially parallel radiation.

The substantially cylindrical dimples as seen in FIGS. 2 and 3 may be formed by indentations on a substantially solid substrate having a reflective material coated or deposited on the exteriorly facing side of the substrate. Alternatively, as will be shown in more detail below for conically shaped and pyramidal shaped dimples, the radiation reflecting surface may be formed or deposited on the interior side of the dimples. In such an alternative construction, it may be appreciated, the substrate upon which the reflective material is formed should be transparent, or at least translucent to expected radiations.

Figure 4:
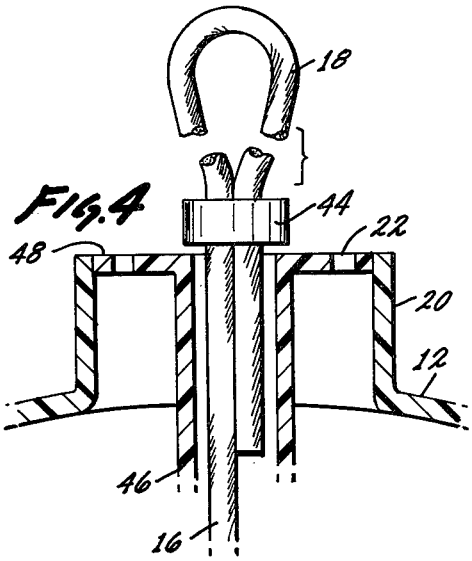
FIG. 4 is an enlarged, cross-sectional elevation of the mounting detail as seen in FIG. 1 along line 4—4 in the direction of the arrows.

The details of the mounting means coupled to the sphere comprising the target 10 can be seen in FIG. 4, an enlarged cross-sectional view of the target 10 of FIG. 1 as seen along lines 4—4 in the direction of the arrows. The partially spherical surface 12 has necks 20 providing diametrically opposed openings through which the cable 16 is threaded. The cable is looped at both ends to form loops 18, and is clamped by suitable clamping means 44 to keep the cable 16 from slipping.

A cylindrical tube 46 encases the cable 16 through the target 10. The cylindrical tube 46 is formed having a flared end 48 substantially covering the opening of the neck 20. The flared end 48 has drain holes 22 opening therethrough to allow water to pass therethrough. There will be no accumulation of water, therefore, inside the target 10 to create difficult handling problems.

Figure 5:
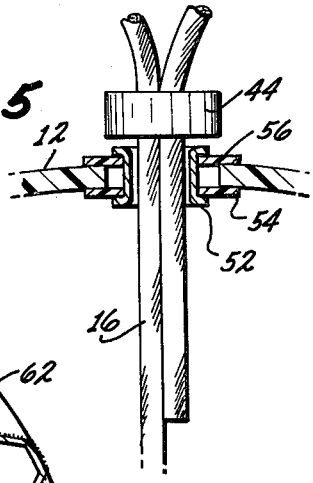
FIG. 5 is an enlarged, partial cross-section of an alternative embodiment of the mounting detail as seen in FIG. 6.

An alternative securing or mounting means is shown in FIG. 5. The cable 16 is threaded through openings in the partially spherical surface 12, and looped back upon itself to form securing loops, as in the embodiment of FIGS. 1 and 4. Again, the cable is joined to itself by a clamp 44. The clamp 44, in both the embodiments of FIGS. 1 and 4, and of FIG. 5 can be selected to be large enough to prevent the clamp 44, and consequently the associated loops 18 from passing into the target 10.

In the embodiment of FIG. 5, a cylindrical tube encasing the cable throughout its diametrical passage is eliminated. Instead, a cylindrical eyelet 52 is positioned at the circular opening of the spherical surface 12. In this embodiment no neck or other protrusion beyond the surface 12 is formed except by the eyelet 52. Annular washers 54, 56 may be placed, one on the inside and one on the outside of the spherical surface 12 to secure the seating of the eyelet 52 in the opening.

In the preferred embodiment, dimples 14 having a basic cylindrical shape are described. Such a shape is particularly useful in taking advantage of the corner reflecting principle. An alternative embodiment encompasses conically shaped dimples which also may take advantage of the corner reflecting principle.

Figure 6:
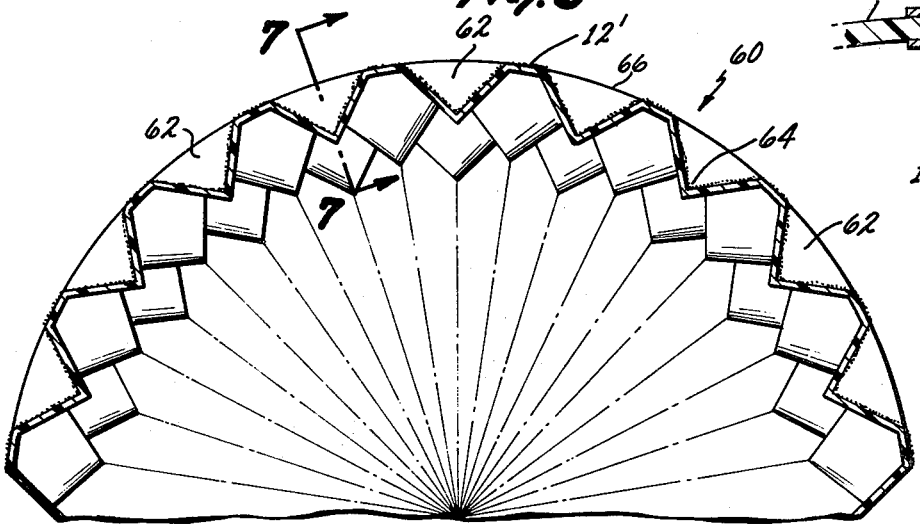
FIG. 6 is a partial, cross-sectional elevation of an alternative embodiment of the reflector target of FIG. 1.

FIG. 6 is a partial cross-section of a target 60, similar in general appearance to the target 10 of FIG. 1, showing the construction of such an alternative embodiment. The view of FIG. 6 is along a plane so as to partition some of the conically shaped dimples 62 in half. Some portions of the partially spherical surface 12' can be seen between the dimples 62 in this embodiment of the invention. The partially spherical surface 12' is made as small as possible so as to maximize the number of dimples 62 opening to the exterior of the target 60.

Each dimple 62 is conical in shape and has a vertex 64. The vertices 64 define an angle $\alpha$ which is, in the practice of the present invention, a 90 degree or right angle. Each dimple opening 66 is circular in shape. The opening has a diameter less in dimension than the wavelength of the "radar" frequencies expected. The size of the dimple 62 in relation to the frequencies reflected will be discussed in detail below. The axes of all dimples 62 intersect the center of the sphere 12', or are normal to the sphere of which surface 12' is a part.

Figure 7:
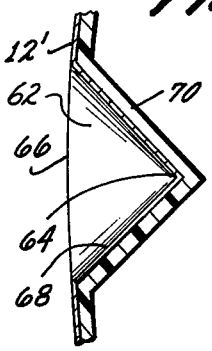
FIG. 7 is a detailed cross-section view of a portion of FIG. 6, as seen along line 7—7 in the direction of the arrows.

A more detailed illustration of a conical dimple 62 can be seen in FIG. 7, an enlarged detail of FIG. 6 taken along line 7—7 in the direction of the arrows. The exteriorly facing sides of the partial surface 12' are coated with a radiation reflecting surface material 68, such as aluminum.

The aluminum may be deposited or otherwise formed on a substrate 70. As in the preferred embodiment, the substrate 70 may be preformed of resin or plastic material, and should be sufficiently thick to withstand any reshaping by wind and normal manual use.

The generally spherical reflector 60 could be formed in octant or quadrant sections and joined together to form the generally spherical target reflector after the deposition of the radar reflecting surface 68. Of course, the reflector 60 could be formed in one piece and substantially covered by the reflecting surface 68.

Figure 8:
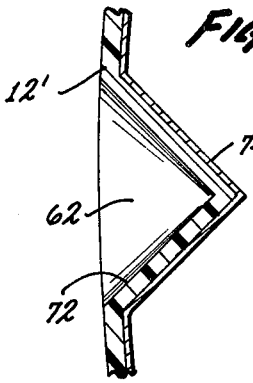
FIG. 8 is a detailed cross-section view of an alternative embodiment of the portion seen in FIG. 7.

FIG. 8 shows in an enlarged, detailed cross-section one half of a dimple 62 in an alternative embodiment of the invention as described in FIG. 7. The substrate 72 is formed in substantially the same shape as substrate 70. In this alternative embodiment, the substrate 72 is transparent or at least translucent to the expected radar frequencies. The radar reflecting surface 74 is deposited on the interior side of the substrate 72. As may be appreciated from a more detailed description below, the radar reflecting surface 74 is thus more suitably protected from exterior objects which might scratch or mar the reflecting surface 74.

The alternative embodiment of FIG. 8 is more suitably constructed by a deposition of the radar reflecting surface material 74 on the interior side of sections of the sphere, such as quadrant sections. After forming the reflecting surface 74 on the substrate 72, the sections could be joined to form the substantially spherical target 60. The same form of structure, and methods of making the structure may be used to form the target 10 having the cylindrical dimples 14.

Figure 10:
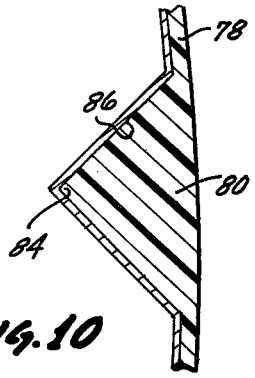
FIG. 10 is an enlarged, detailed cross-section view of a portion of the embodiment of FIG. 9 taken along line 10—10 in the direction of the arrows.
Figure 9:
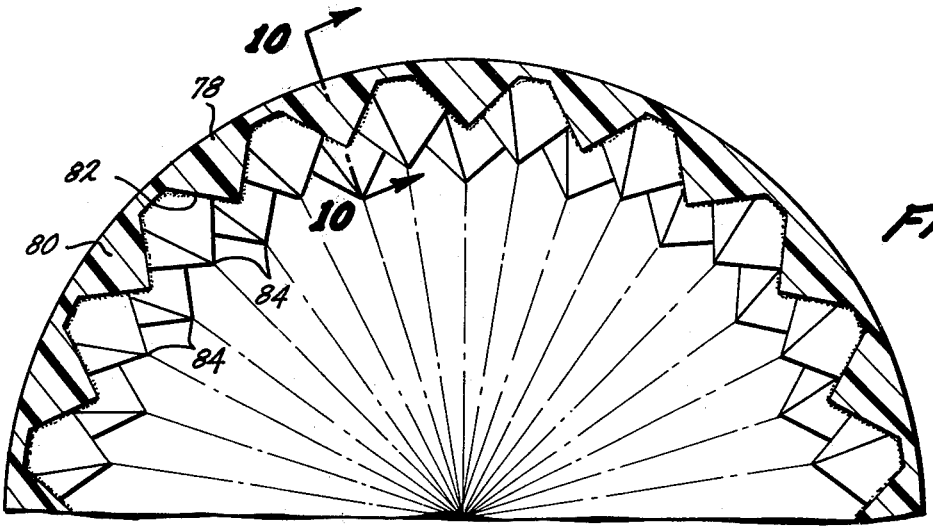
FIG. 9 is a partial, cross-sectional elevation of an alternative form of this alternative embodiment of the invention.

An alternative embodiment of the present invention is illustrated in FIGS. 9 and 10. A substantially spherical surface 78 is formed of a relatively hard, durable substrate 80. The substrate 80 may be a plastic resin, but must be transparent or at least translucent to radiation frequencies intended to be manipulated by the present reflector.

The translucent substrate 80 is formed having protuberances 82 having right angle vertices 84. A radiation reflecting surface 86 is formed or deposited over the entire interior of the substrate 80, including the protuberances 82. This alternative embodiment provides a smooth, more completely spherical exterior surface 78 than is provided by the partially spherical surface 12, 12' of the previously described embodiments of FIGS. 1 through 8. This alternative embodiment, as does the alternative embodiment of FIG. 8, provides a protection against scratching or other damage to the reflective surfaces 74 and 86. While scratches or other damage to the surface 78 and to the exterior face of substrate 72 in FIG. 8 may affect the path of impinging and reflected radiation, the total reflective capabilities of the reflective surfaces 74, 86 remain unimpaired.

FIG. 9 also illustrates an alternative shape of the dimples or, as in the case of FIG. 9, protuberances 82. The protuberances 82 are pyramidal in shape, each having substantially equal sides. The vertices 84, nonetheless, are right angle or 90 degree vertices for operational reasons that will be explained in greater detail below. The bases of the pyramidal dimples 82 form generally square openings. These openings should have a maximum cross dimension which is less than the wavelength of radiation frequencies expected.

The sphere 80 of FIG. 9 alternatively may be formed having cylindrically shaped protuberances. A reflective material such as aluminum may then be coated or otherwise formed on these interior protuberances to provide the spherical outside observed in FIG. 9.

Figure 11:
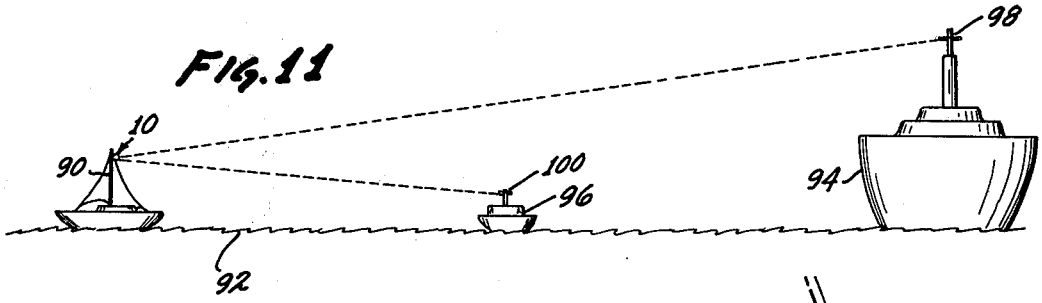
FIG. 11 is an environmental view showing the invention in operation.

In operation, the loops 18 may be secured to appropriate hooks in halyards found on sailboat masts. The target reflector 10 can then be easily hoisted to the top of a sailboat mast 90 as depicted in the environmental view of FIG. 11. The target 10 would be elevated thus a substantial distance above the water surface 92.

A reflector some 40 feet above the waterline can be seen by a radar-transmitting antenna at 10 miles if the antenna is above the waterline some 20 feet. If the antenna is only 10 feet off the water, return radiation can be expected only from reflectors within 4 miles. By use of the present invention, however, it is expected that parallel radar frequency reflection can be accomplished with sufficient strength so as to be seen by a radar-equipped vessel within three miles when the reflector is hoisted approximately 20 feet or more above the waterline.

Both large ships 94 and small boats 96 frequently have radar systems emitting radar frequencies from radar antennae on towers 98, 100. The radar frequencies from the tower 100 would approach the target reflector of the present invention at an acute angle measured relative to the substantially vertical mast 90. Contrarywise, the radar frequencies directionally emitted from the tower 98 of a large vessel 94, would approach the target reflector 10 at an obtuse angle relative to the mast 90. Because of the substantially spherical configuration of the target 10, the radar frequencies of both of these radar transmitters can be directionally reflected along return paths that are very substantially parallel to their respective impinging paths.

The operation of the target reflector 10 can be appreciated by an understanding of the right angles formed by the end edge of the cylinder sidewall 26, or by the vertices of either the conical dimples 62 or the pyramidal dimples or protuberances 82. Incident radiation will pass through the openings of the dimples and reflect off of one portion of the side or off of one of the pyramid's sides. The incident radiation will then reflect off the end 28 or off a portion of the side opposite the point of first impingement, so as to be reflected back through the openings in a path substantially parallel with the impinging radiation, in the well known corner reflector principles of fundamental antenna physics. Further discussion of this principle may be found at Chapter 12 of Kraus, *Antennas,* McGraw-Hill (1950), as well as in the text reference given above.

Because there are a large number of these openings positioned substantially in, or approaching, the surface 12, 12' of the spherical reflector 10, 60, there more probably will be a dimple whose vertical axis approaches coincidence with the impinging radar beam. This coincidence would be formed even in simultaneous radar reception where the radar frequencies are transmitted from antennae, such as antennae 98, 100 at different heights relative to the water surface 92 than is the target reflector 10, 60. The corner reflecting principles of adjacent cylindrical, conical or pyramidal dimples will afford additional parallel reflection along a greater portion of the substantially spherical structure of the reflector 10, 60. Of course, vertices having angles slightly deviate from 90 degrees may provide return radiation to the radar transmitter even though not along a path perfectly parallel to the transmitted radiation. While not the most desired, such a configuration can be seen to come within the spirit or equivalence of the present structure insofar as it allows suitable radar reflection to the transmitter-receiver.

The target reflector 10, 60 can easily rotate about the diametrically threaded cable 16. The cable 16 is kept from chafting or otherwise damaging the structure of the target reflector by virtue of either the cylindrical tube 46 in the embodiment of FIG. 4, or by the eyelets 52 in the embodiment of FIG. 5. Significantly, the substantially spherical structure of the target reflector 10, 60 presents no rough or sharp edges to the exterior. Consequently, the free rotation of the target reflector 10, 60 will not damage, scratch or otherwise impair the mast 90.

Figure 12:
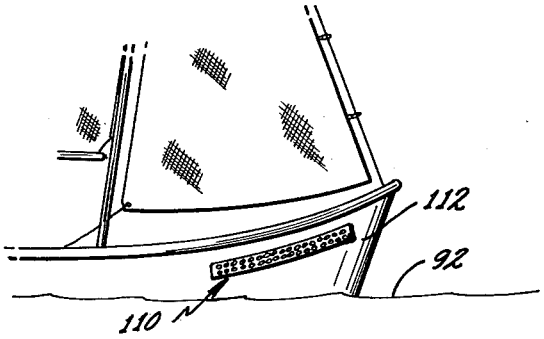
FIG. 12 is an environmental view showing yet another alternative embodiment of the invention in operation.

The reflective capabilities of the unique dimpled structure as taught herein can be realized even if the target reflector is substantially not a sphere. For example, a substantially rectangular surface having the dimples employing the corner reflective principle can be used. In FIG. 12, such a substantially curved, rectangle-shaped target reflector is shown mounted on the curved surface of a boat's hull.

It might be appreciated that principles of the present invention are readily adaptable to any irregularly curved shape. Radiation from any transmitted source can be received by the dimples on the rectangular, curved target reflector, and reflected by the dual or triple reflection within the dimples along a path parallel to the impinging radiation.

The structure of the present invention is particularly useful in racing sailboats. A clearly defined objective in sailboat racing is the minimization of wind resistance area. In experiments it has been found that a prototype reflector constructed in accordance with the present invention will give radar radiation reflection comparable to the three intersecting plane type reflectors of the prior art having a diameter dimension substantially larger than that of the prototype. For example, a target reflector constructed in accordance with the embodiment of FIG. 1 and having a diameter of approximately 5 inches was irradiated by a standard marine radar transmitter using frequencies in the three centimeter to ten centimeter bands. The openings in the dimples were approximately one centimeter in diameter.

The reception of the reflected radiation was found to be as strong as the reception of radiation reflected from a reflector constructed substantially in the form of the known prior art, having three intersecting sheets of reflecting material and having a cross dimension of 10 inches. As can be seen, therefore, using the structure of the present invention permits the use of a reflector having substantially less wind resistance while achieving a comparable or equal degree or strength of radar reflection.

It may also be appreciated that the substantially spherical exterior of the reflector of the present invention inherently provides less wind resistance than the flat reflective surfaces of most of the known prior art. Since the volume occupied by a sphere varies inversely to the square of its radius, it is seen that reducing the diameter of the reflector by half reduces the volume occupied by a factor of four, thus realizing a quite significant wind resistance reduction while maintaining reflective strength and radar visibility. The substantially spherical shape of the reflector of the present invention also provides a relatively smooth exterior having no flat surfaces for catching wind, and no edges which might damage boats.

It is not completely understood how having the maximum dimension of the openings of the dimples less than the wavelength of the marine radar frequencies anticipated affords the superior reflecting capabilities as demonstrated in the experiment recorded herein. Perhaps at least one of the dimple axes is coincidental with the axis of the impinging radiation, and is cumulatively added to the additional reflection provided by the adjacent dimples, thus providing the superior results.

In any event, it is believed that maximum advantage may be obtained by restricting the maximum dimension of the openings of the dimples to a fraction of the wavelengths of the impinging radiation anticipated. Most marine radar systems operate in frequencies between three and nine gigaHertz, having wavelengths between three and ten centimeters. Thus an opening dimension of approximately one centimeter would be only a fraction of the anticipated impinging frequencies.

Although particular embodiments of the present invention have been described and illustrated herein, other embodiments of the present invention and modifications of these embodiments can be perceived by those skilled in the art without departing from the present invention. Accordingly, it is intended that the present invention should be limited only by the scope of the claims appended below.

What is claimed is:

1. A radiation reflector target for use on substantially non-reflective objects, comprising:

a radar reflective sphere having a substantially spherical surface;

a plurality of radar reflective dimples indented from said substantially spherical surface, each dimple having a right angle corner and defining an opening substantially at the surface of said sphere which opening defines a maximum cross-dimension less than the wavelength of radar frequencies to be received; and mounting means rotatably coupled to said sphere, and extending beyond said sphere, for connecting said target to an object.

2. The reflective target of claim 1 wherein each dimple is in the form of a right angle cone, each cone presenting a circular opening substantially at the surface of said sphere.

3. The radar reflective target of claim 1 wherein each dimple comprises a pyramid having a right angle vertex.

4. The radar reflective target of claim 1 further including means for supporting said radar reflective sphere.

5. The radar reflective target to claim 4 wherein said means for supporting said radar reflective sphere includes a relatively hard substrate formed of plastic.

6. The radiation reflective target of claim 5 wherein the relatively hard substrate is translucent to anticipated illuminating radiation, and forms an outer surface of the radar reflective sphere, and wherein a radar reflective material is formed on the relatively hard substrate opposite the outer surface of the sphere.

7. The radar reflective target of claim 5 wherein the relatively hard substrate forms an inner surface of the radar reflective sphere, and wherein a radiation reflective material is formed on an exterior surface of the radar reflective target.

8. The radar reflective target of claim 1 wherein the means for connecting the target includes a metallic cable including means for securing the target to the marine vessel.

9. The radar reflective target of claim 8 wherein said mounting means includes a cable having a first loop extending beyond the partially spherical surface, and having a second loop extending diametrically opposite said first loop beyond the partially spherical surface.

10. The radar reflective target of claim 9 wherein said object is the mast of a marine vessel having halyards, and wherein said loops can be removably secured to said halyards for hoisting on said mast.

11. A radiation reflective target for use on substantially non-reflective objects, comprising:

a radar reflective sphere having a substantially spherical surface;

a plurality of radar reflective dimples indented from said sphere, each dimple having a right angle corner in the form of a cylinder having a cylindrical sidewall and a generally circular end, and a generally circular corner between said sidewall and said end; and mounting means rotatably coupled to said sphere, and extending beyond said sphere, for connecting said target to an object.

12. The reflective target of claim 11 wherein each said dimple presents generally circular openings in said partially spherical surface, each opening being defined by a respective cylindrical sidewall, and wherein each opening defines a diameter less than the expected wavelength of radar frequencies to be received.

13. A radiation reflective surface having a plurality greater than eight of radiation reflective indentations, each said indentation having a right angle corner and defining an aperture opening exteriorly of said surface, said aperture opening defining a plane approaching said surface and said aperture opening having a cross-dimension less than a wavelength of radiation expected to be received.

14. The radiation reflective surface of claim 13 wherein the radiation reflective surface including said aperture openings approaches a surface of a sphere.

15. The radiation reflective surface of claim 13 further comprising a relatively hard, formed substrate in contact with the radiation reflective surface.

16. The radiation reflective surface of claim 15 wherein the radiation reflective surface is formed exteriorly of and onto the relatively hard, formed substrate.

17. The radiation reflective surface of claim 15 wherein the relatively hard, formed substrate is transparent to radar frequencies, and comprises a spherical exterior surface having interiorly directed protuberances in the form of said indentations, and wherein the radiation reflective surface is formed interiorly of the relatively hard, formed substrate.

18. The radiation reflective surface of claim 13 wherein each indentation comprises a cone.

19. The radiation reflective surface of claim 13 wherein each indentation comprises a pyramid.

20. The radiation reflective surface of claim 13 wherein said indentation comprises a cylinder having an interior circular end at a right angle to the cylinder side.

* * * * *